US006035875A

United States Patent [19]

Chen

[11] Patent Number: 6,035,875

[45] Date of Patent: Mar. 14, 2000

[54] ROOF TENT FOR AUTOMOBILES

[76] Inventor: Jian-Liang Chen, P.O. Box 55-175, Taichung, Taiwan

[21] Appl. No.: 09/098,332

[22] Filed: Jun. 17, 1998

[51] Int. Cl.[7] ..... E04H 15/06

[52] U.S. Cl. ..... 135/88.07; 135/88.05

[58] Field of Search ..... 135/88.07, 88.05

[56] References Cited

U.S. PATENT DOCUMENTS

| | | | |
|---|---|---|---|
| 2,679,255 | 5/1954 | Stafford | 135/88.07 |
| 2,825,351 | 3/1958 | Thornton | 135/88.07 |
| 2,859,756 | 11/1958 | Barnes | 135/88.07 |
| 2,942,609 | 6/1960 | Ferguson | 135/88.07 |
| 3,010,462 | 11/1961 | Barber | 135/88.07 |
| 3,018,783 | 1/1962 | Tyson | 135/88.07 |
| 3,255,768 | 6/1966 | Lowe | 135/88.07 |
| 3,952,758 | 4/1976 | Addison | 135/88.07 |

*Primary Examiner*—Beth Aubrey

[57] ABSTRACT

A roof tent for automobiles comprises a rectangular frame including first and second half sub-frames being hinged together, a canopy enclosing tent, a collapsible pole assembly for supporting tent including inverse U-shaped poles each having two equal parts consisting of a vertical and a horizontal poles hinged together, vertical poles further hinged together with first and second sub-frames, a rope assembly having two first ropes connecting second sub-frame and horizontal poles, and two second ropes connecting the vertical poles, an attachment mechanism being slidable on grooved rail of the vehicle, two cushion members for enhancing stability, and four stops releasably secured on grooved rails. This provides a roomy space for allowing at least four persons to sleep therein.

1 Claim, 7 Drawing Sheets

ROOF TENT FOR AUTOMOBILES

FIELD OF THE INVENTION

The present invention relates to a tent, and more particularly to a foldable tent on railed roof of a van type truck.

BACKGROUND OF THE INVENTION

In general, in camping or other outdoor activities people prefer to bring tents for relaxing, sleeping, and being protected from sun, rain, and wild animals. Accordingly, a variety of tents are available. One of typical tents has a shell shaped configuration including a lower portion secured to the roof of a vehicle, an upper portion hinged to the rear end of the lower canopy, and a canopy enclosing the tent. The canopy is provided with a zippered screen door. These two portions are collapsed and secured on top of vehicle roof in transportation, while being readily extended when in use. However, the upper portion is only permitted to extend about 45° relative to the lower portion for defining a space capable of permitting only two persons to lie down in a direction parallel to the vehicle. As a result, people sleeping therein feel very uncomfortable due to the crowded tent space.

Thus, it is desirable to provide a new and improved vehicle mounted tent in order to overcome the above drawback of the conventional tent.

SUMMARY OF THE INVENTION

It is an object of the present invention to provide a roof tent for automobiles capable of being readily extended to a maximum space for permitting at least four persons to sleep therein.

It is another object of the present invention to provide a roof tent for automobiles which is roomy and comfortable.

The above and other objects, features and advantages of the present invention will become apparent from the following detailed description taken with the accompanying drawings.

DETAILED DESCRIPTION OF PREFERRED EMBODIMENTS

Figure 1:
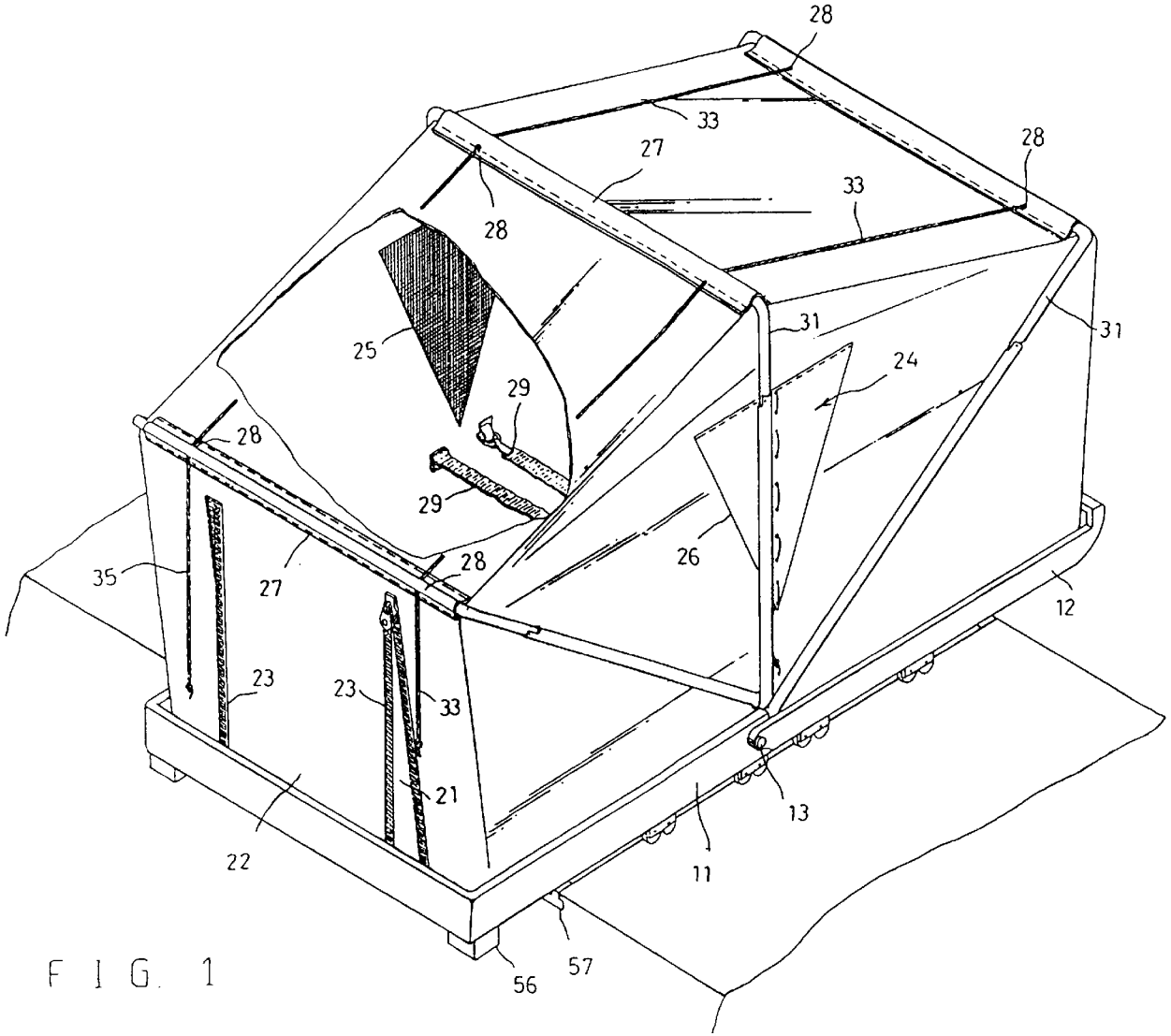
FIG. 1 is a perspective view of a roof tent according to the present invention, the tent being in an extended position and a portion removed to show features therein.
Figure 2:
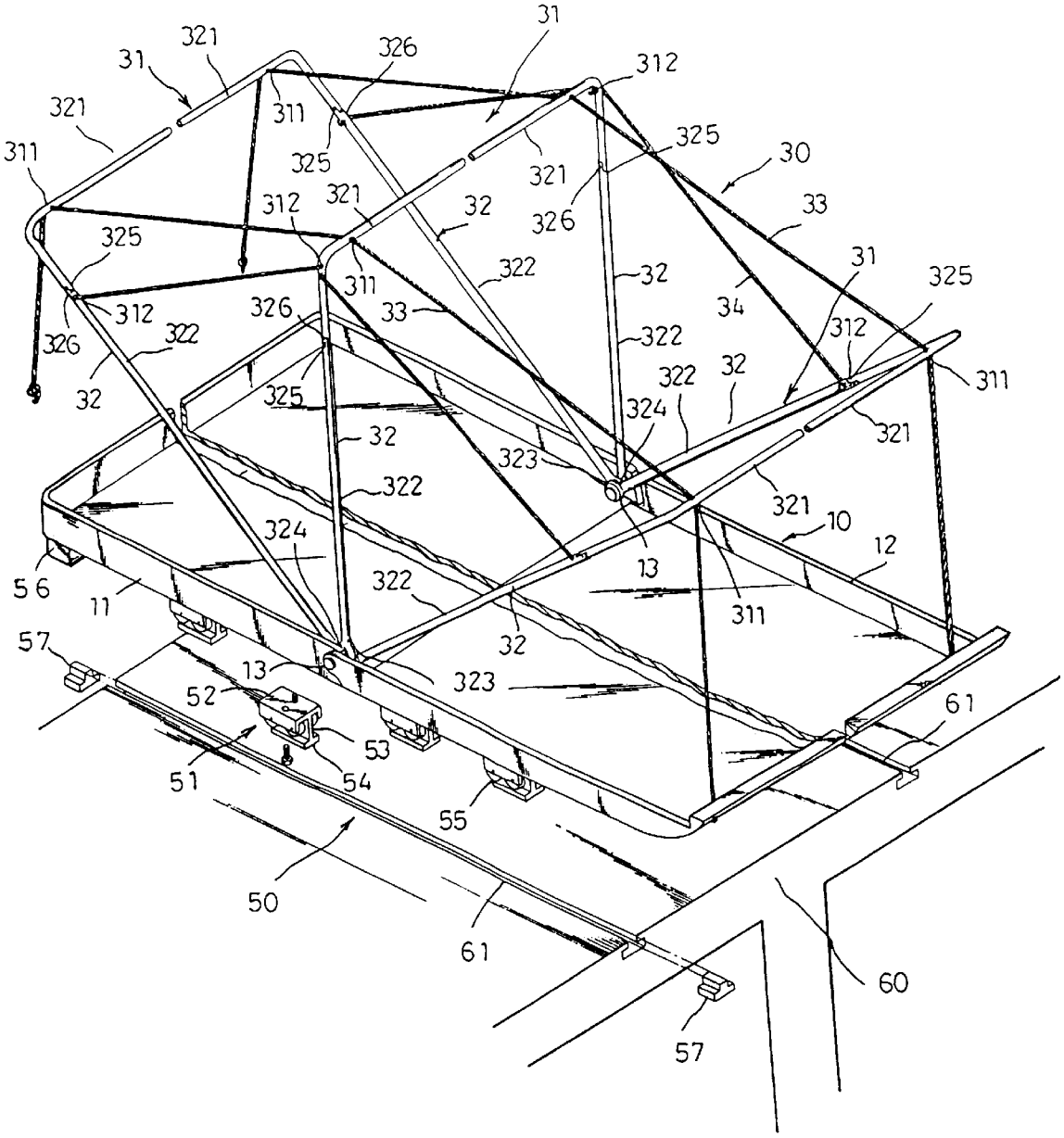
FIG. 2 is view similar to FIG. 1 with canopy removed to show the frame of tent and its attachment mechanism to a railed roof.

Referring to FIGS. 1 and 2, there is shown a roof tent for automobiles of the invention comprising a substantially rectangular frame 10 as a base, a canopy 20 for enclosing tent, a collapsible pole assembly 30 for supporting tent, and a slidable attachment mechanism 50 for sliding on vehicle roof.

The rectangular frame 10 comprises a first half sub-frame 11 and a second half sub-frame 12 hinged together at their respective ends with a pair of pins 13.

The canopy 20 is provided as a hutted configuration having its perimeter connected to the frame 10. The canopy 20 comprises a pair of entrances 21 at the opposing side walls each being closed by a screen 22 and a zipper 23 combination, a pair of windows 24 of substantially triangular shape centrally formed at front and rear walls respectively each having a screen 25 and a pair of flaps 26, a plurality of sleeves 27 equally spaced provided on the roof of tent each having a pair of spaced apart through a plurality of holes 28, and a pair of strap and clasp assemblies 29 in which one connected from front wall to rear wall and the other connected from rear wall to front wall and the other for preventing front and rear walls of tent from moving outward to interfere with the frame 10 when tent is collapsing.

The pole assembly 30 comprises a plurality of substantially inverse U-shaped poles each having a pair of equal parts of inverse L-shaped each part consisting of a vertical pole 32 and a horizontal pole 31. The vertical pole 32 and the horizontal pole 31 are hinged together in a joint 325 by means of a pin 326. Each of the vertical poles 32 has a hole 324 at its lower end 323 such that the lower ends 323 of the vertical poles 32 can be hinged together by the pin 13. The horizontal pole 31 has a through hole 311 and the vertical pole 32 has a through hole 312 respectively. The provision of the horizontal pole 31 is to increase the height of tent. One end of each of two spaced first ropes 33 is secured to the horizontal part of the second sub-frame 12. Each the first rope 33 extends to insert the through hole 311 of each the horizontal pole 31. The other end of the first rope 33 is suspended in front of the entrance 21. One end of each of two spaced second ropes 34 is secured to the vertical pole 32 in the through hole 312 to the right side, and the other end is secured to the vertical pole 32 in the through hole 312 to the left side, and the second rope 34 is inserted through the through hole 312 on the center pole.

The slidable attachment mechanism 50 comprises a plurality of spaced sliding members 51 of substantially T-shaped section secured to the underside of the first and the second sub-frame 11 and 12. Each the sliding member 51 has an inverse U-shaped upper portion 52, a lower horizontal portion 54, a central vertical portion 53 connected between upper portion 52 and lower horizontal portion 54, and a pair of wheels 55 provided on both sides of the vertical portion 53. A pair of spaced cushion members 56 are provided under a bent portion of the first sub-frame 11 for enhancing the stability of the frame 10. A plurality of stops 57 of inverse T-shaped section each releasably secured to an end of each of a pair of transverse grooved rails 61.

Figure 3:
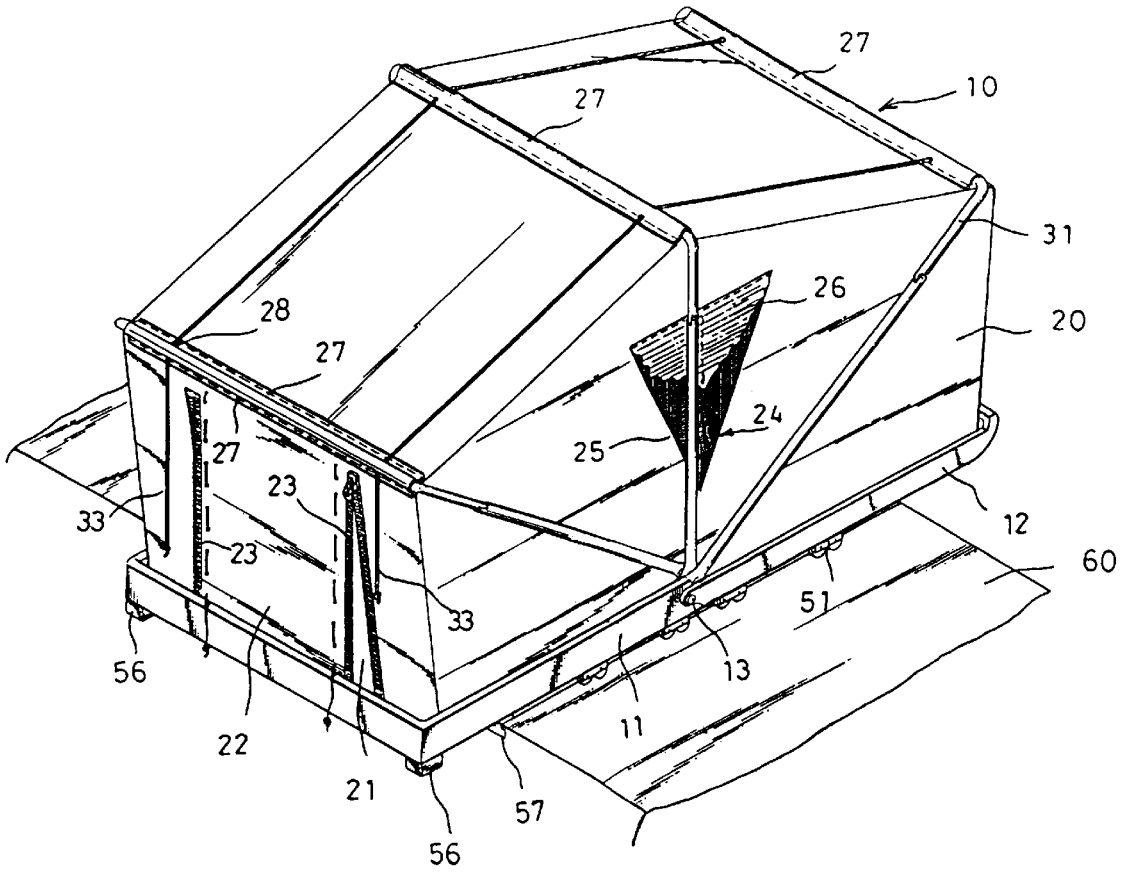
FIG. 3 is a perspective view of the roof tent according to the present invention, the tent being in an extended position.
Figure 4:
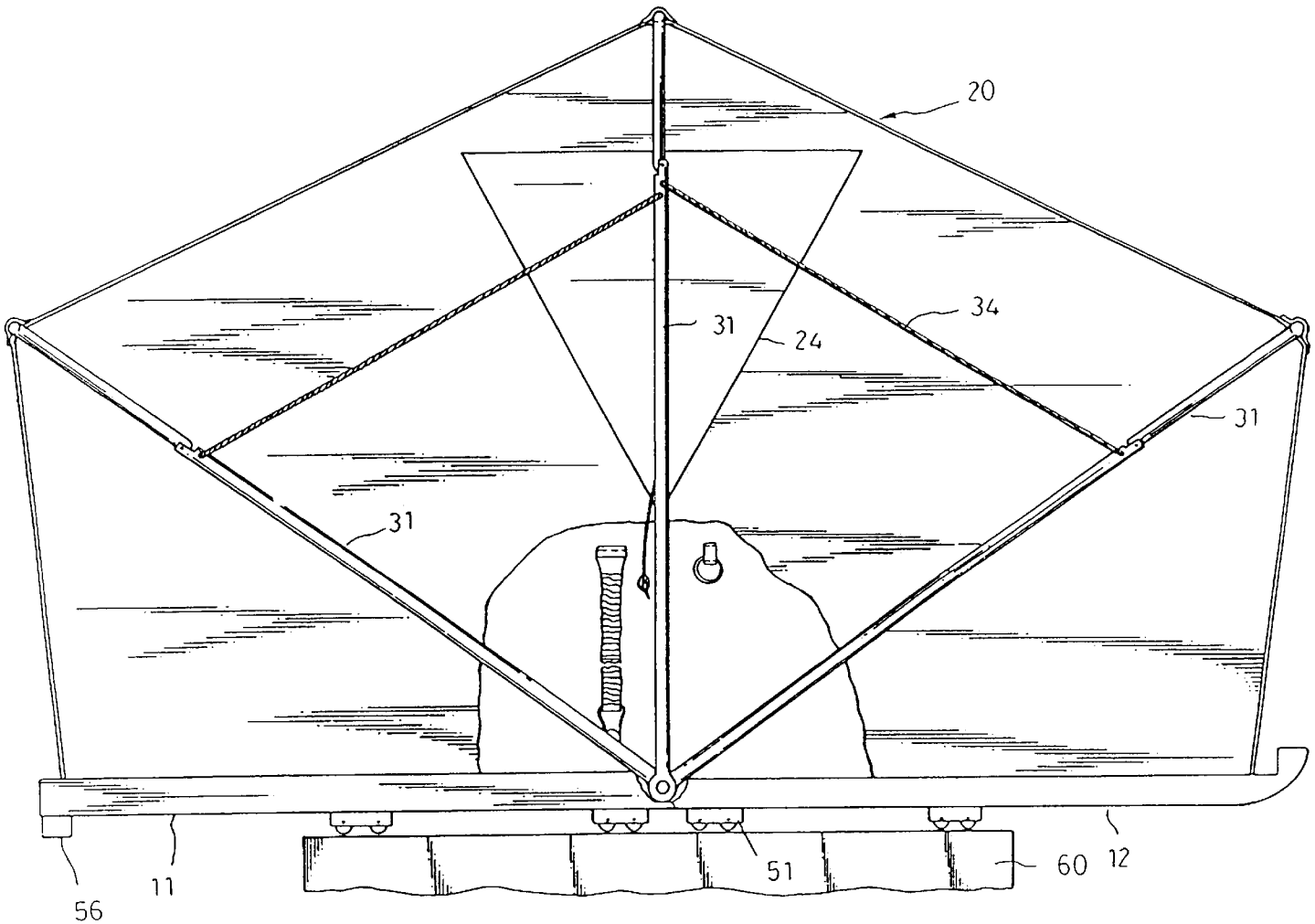
FIG. 4 is a side view of FIG. 3.

Referring to FIGS. 3 and 4 illustrate a fully extended tent in which each of the first ropes 33 is further inserted the through holes 28 of the sleeves 27 to secure the canopy 20 on tent, the tent is slidable by means of the sliding members 51 moving along the grooved rails 61 of a van 60, while the wheels 55 provides a smooth movement of the sliding members 51, and the stops 57 are mounted to prevent tent from being moved further outwardly. In addition, the window 24 is open by drawing a cord to lift the flaps 26 up (FIG. 3).

Figure 5:
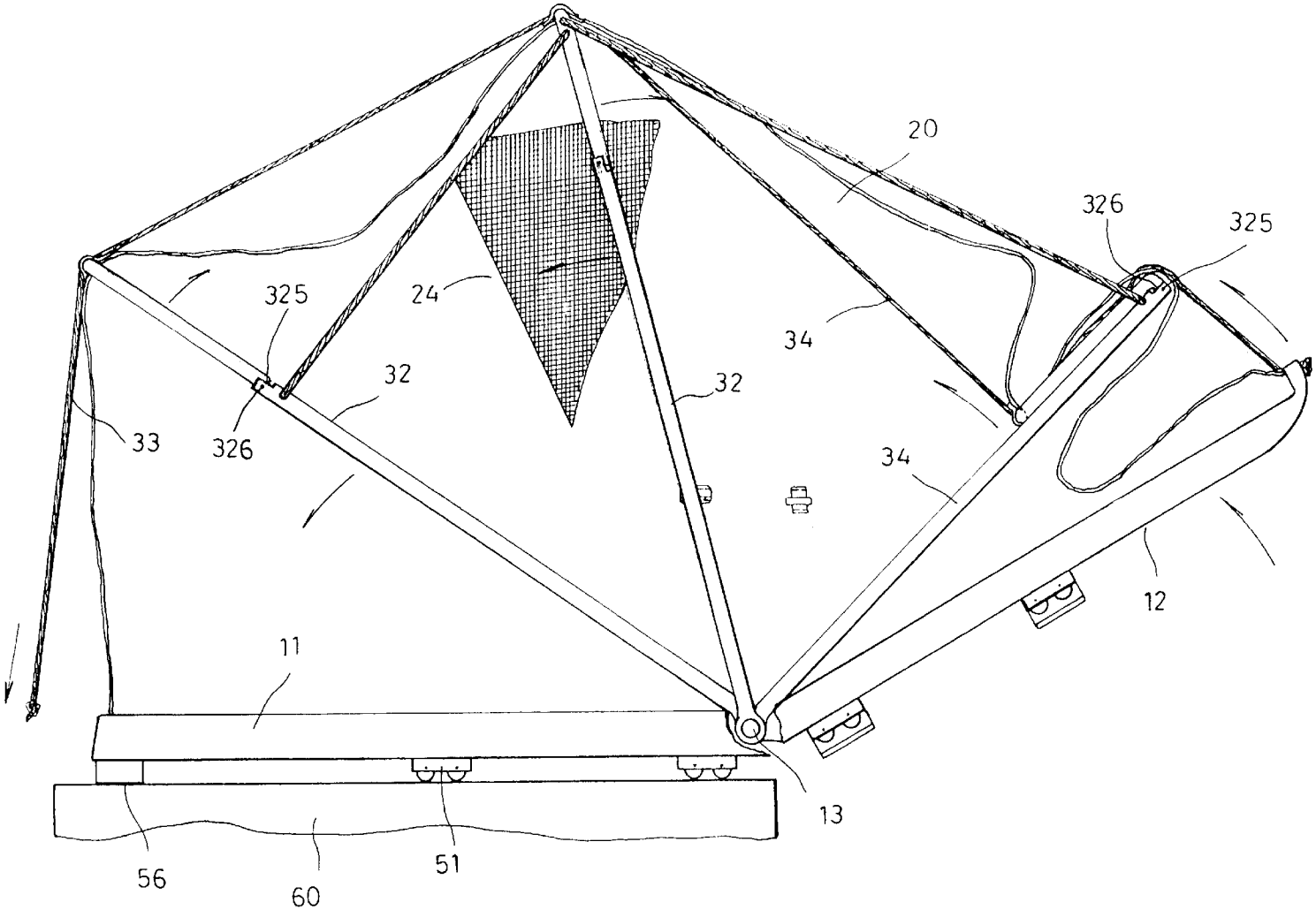
FIG. 5 is a side view showing tent in collapsing.
Figure 6:
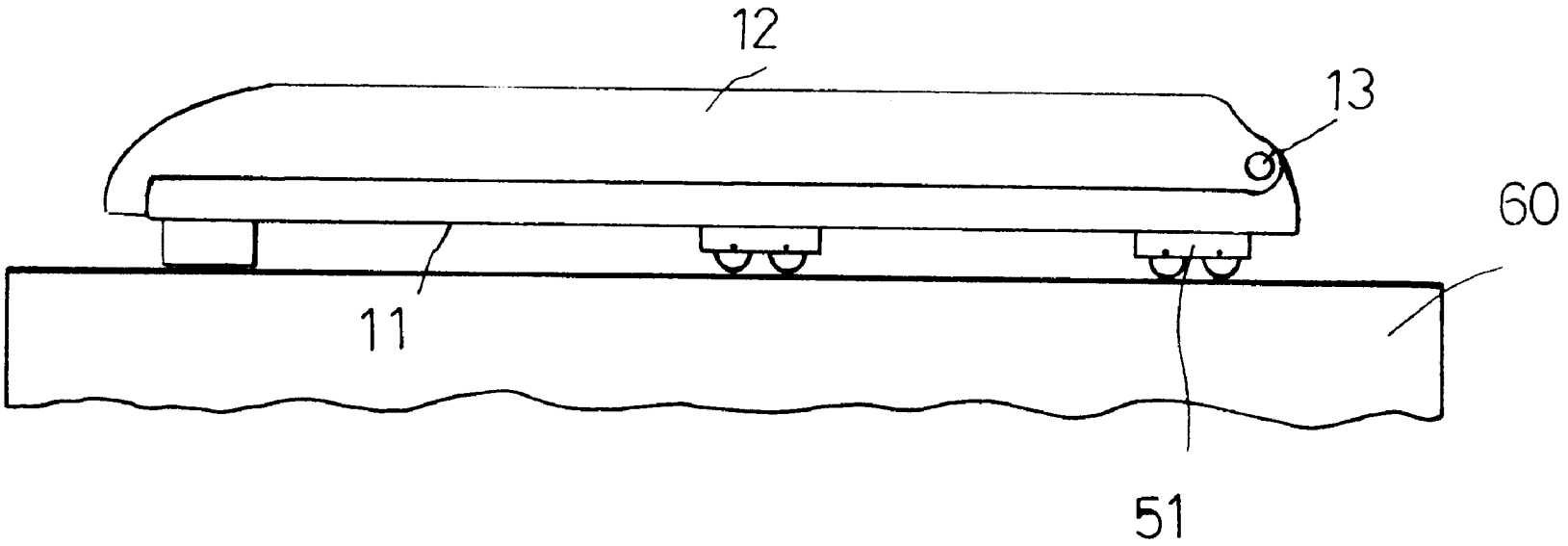
FIG. 6 is a side view showing the collapsed tent secured on a vehicle.

Referring to FIGS. 5 and 6, when collapsing the tent first remove the stops 57 from ends of the grooved rails 61. Then push the first sub-frame 1I1 inwardly relative to the van 60 until the second sub-frame 12 and the sliding members 51 beneath thereof moving out of the rails 61. Finally, draw the first ropes 33 to retract the second subframe 12 onto the first sub-frame 11 so as to collapse tent. Note that the horizontal pole 31 is folded to attach to the vertical pole 32 when tent is collapsed so as to conform to the length of vertical portion of the first sub-frame 11.

Figure 7:
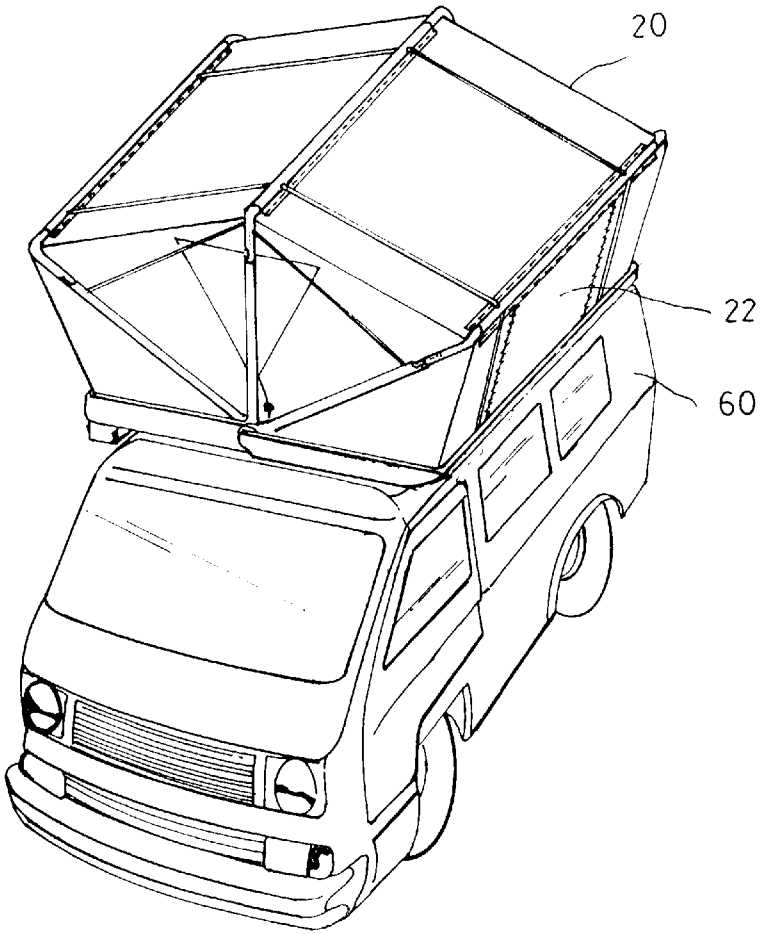
FIG. 7 is a perspective view of the extended tent mounted on a van truck.

FIG. 7 shows the extended tent is mounted on the van 60 in which two lateral entrances 22 are provided to facilitate people to enter or leave tent, while roomy interior allows at least four adults to sleep therein. Thus a comfortable shelter is provided.

While the invention herein disclosed has been described by means of specific embodiments, numerous modifications and variations could be made thereto by those skilled in the art without departing from the scope of the invention set forth in the

What is claimed is:

1. A roof tent for automobiles having a pair of spaced transverse grooved rails on a roof, comprising:

a substantially rectangular frame including a first half sub-frame and a second half sub-frame each being of U-shaped having a horizontal part and a vertical part, the first and the second half-frames are hinged together at their respective ends with a pair of first pins;

a rear, two sides, and a top with its perimeter connected to the frame including one or more entrances, one or more windows on the opposing sides, at least three sleeves equally spaced provided on the canopy each having at least two spaced apart first holes, and one or more strap and clasp assemblies connected between the opposing sides of the canopy;

a collapsible pole assembly for supporting the tent including at least three substantially inverse U-shaped poles each having two equal parts of inverse L-shaped each part consisting of a vertical pole and a horizontal pole hinged together in a joint by means of a second pin, the lower ends of the vertical poles further hinged together with the first and the second sub-frames by one of the first pins, each of the horizontal poles having a second hole, and each of the vertical poles having a third hole;

a rope assembly having a pair of first spaced ropes with one end of each of the first ropes secured to the horizontal part of the second sub-frame, extended to insert through the second hole of each of the horizontal poles, and the other end of each of the first ropes suspended in front of each of the entrances, and a pair of a second spaced ropes each connecting the vertical poles through the third holes thereof;

a slidable attachment mechanism for sliding on the grooved railed of the automobile including a plurality of spaced sliding members of substantially T-shaped section secured to an underside of the first and the second sub-frames with each of the sliding member having an inverse U-shaped upper portion, a lower horizontal portion, a central vertical portion connected between the inverse U-shaped upper portion and the lower horizontal portion, and a plurality of wheels provided on both sides of the central vertical portion;

a pair of spaced cushion members provided under a bent portion of the first subframe for enhancing a stability of the first sub-frame; and four stops of inverse T-shaped section each releasably secured to an end of each of the transverse grooved rails;

wherein each of the first ropes is further inserted through the first holes of the sleeves to secure the canopy on the tent, the tent is slidable by means of the sliding members moving along the grooved rails, while the wheels provide a smooth movement of the sliding members on the grooved rails, and the stops are mounted to prevent the tent from being moved further outwardly in a first position, while remove the stops from the grooved rails, push the first sub-frame inwardly until the second sub-frame moving out of the grooved rails, and draw the first ropes to retract the second sub-frame onto the first sub-frame in a second position.

* * * * *